US010561864B2

(12) United States Patent
Niewiadomski et al.

(10) Patent No.: US 10,561,864 B2
(45) Date of Patent: Feb. 18, 2020

(54) COUPLING DEVICE FOR A BREATHING APPARATUS

(71) Applicant: MSA Europe GmbH, Jona (CH)

(72) Inventors: Lukasz Niewiadomski, Siedlce (PL); Peter Kadow, Berlin (DE); Peter Kling, Berlin (DE)

(73) Assignee: MSA EUROPE GMBH, Jona (CH)

( * ) Notice: Subject to any disclaimer, the term of this patent is extended or adjusted under 35 U.S.C. 154(b) by 236 days.

(21) Appl. No.: 14/377,611

(22) PCT Filed: Feb. 8, 2013

(86) PCT No.: PCT/EP2013/052490

§ 371 (c)(1),
(2) Date: Aug. 8, 2014

(87) PCT Pub. No.: WO2013/117676

PCT Pub. Date: Aug. 15, 2013

(65) Prior Publication Data

US 2015/0075523 A1 Mar. 19, 2015

(30) Foreign Application Priority Data

Feb. 9, 2012 (DE) ..... 10 2012 201 945

(51) Int. Cl.
*A62B 9/04* (2006.01)
*A62B 7/12* (2006.01)
(Continued)

(52) U.S. Cl.
CPC ..... *A62B 9/04* (2013.01); *A62B 7/12* (2013.01); *A62B 9/022* (2013.01); *A62B 18/02* (2013.01)

(58) Field of Classification Search
CPC ..... A61M 16/0833; A61M 16/0087; A61M 16/0816; A61M 16/12; A61M 16/0875;
(Continued)

(56) References Cited

U.S. PATENT DOCUMENTS 2,818,066 A * 12/1957 Glidden ..... A62B 7/00 128/205.24
3,556,098 A * 1/1971 Kanwisher ..... A61M 16/0051 128/202.22
(Continued)

FOREIGN PATENT DOCUMENTS

BE 529261 A 5/1957
DE 3937513 A1 * 5/1991 ..... A62B 9/04
(Continued)

OTHER PUBLICATIONS

International Search Authority, Search Report for International Application PCT/EP2013/052490, dated Apr. 14, 2014, 1 page, Rijswijk, NL.
(Continued)

*Primary Examiner* — Bradley H Philips
*Assistant Examiner* — Victoria Murphy
(74) *Attorney, Agent, or Firm* — The Webb Law Firm

(57) ABSTRACT

A coupling device for a breathing apparatus, characterized in that a connecting device is inseparably connected to the regulator hose, and can be coupled with at least two couplers, each having a flow check valve, for connection to a breathing gas source. Other aspects are described and claimed.

5 Claims, 5 Drawing Sheets

(51) Int. Cl.
*A62B 9/02* (2006.01)
*A62B 18/02* (2006.01)

(58) Field of Classification Search
CPC .. A62B 9/04; A62B 9/022; A62B 7/02; A62B 7/12; A62B 18/02; A62B 7/00; A62B 9/02; B63C 11/18; B63C 11/22
USPC ..... 128/202.27
See application file for complete search history.

(56) References Cited

U.S. PATENT DOCUMENTS

| | | | | | |
|---|---|---|---|---|---|
| 3,777,771 | A * | 12/1973 | De Visscher | F16L 29/04 | 137/1 |
| 4,378,028 | A * | 3/1983 | Weber | F16L 37/23 | 137/614.04 |
| 4,949,745 | A | 8/1990 | McKeon | | |
| 5,738,088 | A * | 4/1998 | Townsend | B63C 11/18 | 128/202.27 |
| 6,360,742 | B1 * | 3/2002 | Maxwell | A62B 9/04 | 128/202.27 |

FOREIGN PATENT DOCUMENTS

| | | |
|---|---|---|
| DE | 19946269 A1 | 5/2001 |
| EP | 2407208 A1 | 1/2012 |

OTHER PUBLICATIONS

International Bureau of WIPO, Preliminary Report on Patentability for International Application PCT/EP2013/052490, dated Aug. 21, 2014, 8 pages, Geneva, Switzerland.

* cited by examiner

COUPLING DEVICE FOR A BREATHING APPARATUS

CLAIM FOR PRIORITY

This application claims priority to German Patent Application No. 10 2012 201 945.6, filed on Feb. 9, 2012.

TECHNICAL FIELD

The subject matter described herein relates to a coupling device for a breathing apparatus.

BACKGROUND

Self-contained breathing apparatus are used in many fields, for example, as fully portable compressed air breathing apparatus having a compressed air cylinder. In such cases, breathing gas (e.g., air) flows out of a pressure cylinder as the breathing gas source through a system of lubes or hoses, which are equipped with shut-off and control devices, to a regulator.

A typical use for such fully portable breathing apparatus is as compressed air breathing apparatus for use by firefighters or for industrial applications. Industrial applications, for example, in a petrochemical plant, involve providing protection against toxic gases, particularly hydrogen sulfide. In such cases it can particularly be necessary for the breathing apparatus to be small and lightweight in design so that they will not hinder an escape. However, because chemical plants are becoming increasingly larger, a wearer of an apparatus may need to switch out his breathing gas source and attach a new compressed gas cylinder, for example.

BRIEF SUMMARY

In summary, one aspect provides a coupling device for a breathing apparatus, characterized in that a connecting device (10) is inseparably connected to the regulator hose (20) and can be coupled to at least two couplers (11, 12), each having a flow check valve (13, 14), for connection to a breathing gas source (1).

A breathing system, comprising: a connecting device connected to a regulator hose; the connecting device having at least two coupler portions; each of the at least two coupler portions configured for reversible connection to a corresponding coupler portion of a breathing hose.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

BRIEF DESCRIPTION OF THE SEVERAL VIEWS OF THE DRAWINGS

Example embodiments are illustrated in the drawings, in which.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

A wearer of a breathing apparatus may need to switch out his breathing gas source and attach a new compressed gas cylinder, for example. A problem addressed by the various embodiments is therefore that of providing a coupling device that will enable a rapid switching from one breathing gas source to another. Embodiments provide a coupling device, certain features of which are described throughout. The scope of the claimed invention is provided in the claims.

Figure 1:
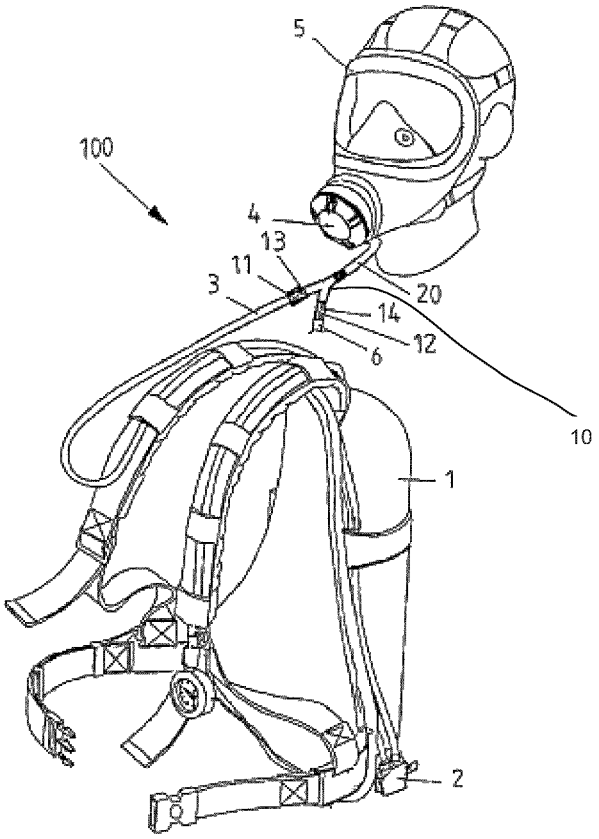
FIG. 1 illustrates a breathing apparatus with one embodiment of a coupling device.

FIG. 1 illustrates components of a fully portable, self-contained breathing apparatus 100. The breathing gas—in this example air—is stored under a pressure of approximately 300 bar in a breathing gas cylinder 1 as the breathing gas source. The pressurized breathing gas is conducted to a pressure reducing valve 2 at a mean pressure of between 5 and 10 bar, and is conducted via an intermediate pressure line 3 to the regulator 4. The regulator 4 reduces the pressure to ambient pressure and is connected to a mask 5 for the apparatus wearer. With a suitable design of the regulator 4, the delivery of the breathing gas is adapted to the needs of the apparatus wearer.

In many cases, it is expedient for the apparatus wearer to have the option of connecting to different breathing gas sources 1. This eventuality can occur, for example, when the breathing gas cylinder 1 is empty and another must be connected. It may also be necessary for the apparatus wearer to connect to a stationary source of breathing gas—at least temporarily.

Therefore, the embodiment of a coupling device illustrated in FIG. 1 comprises a connecting device 10 and two couplers 11, 12 for breathing gas sources 1. In principle, more than two couplers 11, 12 can also be provided. Each coupler 11, 12 comprises a male coupling piece 11*a*, 12*a* and a female coupling piece 11*b*, 12*b*, wherein each male coupling piece 11*a*, 12*a* can be connected to a female coupling piece 11*b*, 12*b* (see FIG. 2). In what follows, the term coupler 11, 12 is also used to refer to a piece comprising a male coupling piece 11*a*, 12*a* and a female coupling piece 11*b*, 12*b*.

The connecting device 10 in the embodiment illustrated in FIG. 1 has a Y-shape. The base of the connecting device 10 is connected securely, i.e., inseparably, to the regulator hose 20.

Breathing gas lines 3, 6 can each be coupled via couplers 11, 12 to the two legs of the Y-shaped embodiment of the connecting device 10. A detachable connection with the intermediate pressure line 3 and therefore with the first breathing gas source 1 is produced by means of a first coupler 11*a*, 11*b*. In this case, a coupling of the second coupler 12*a*, 12*b* is open, i.e., there is no connection to a second breathing gas source.

The connecting device 10 is therefore arranged securely at the location in the breathing apparatus 100 that receives the breathing gas, since it is inseparably connected to the line that leads to the regulator 4. Therefore, the pressurized gas cylinder 1 can be easily uncoupled using the first coupler 11*a*, 11*b* when a new breathing gas cylinder 1 or a different breathing gas source 1 has been connected with the second coupler 12*a*, 12*b*. A faster and safer exchange of devices is thereby possible. When the breathing apparatus is used as an escape apparatus, for example, the apparatus wearer would leave the empty breathing gas cylinder 1 and the pressure reducing valve 2 behind.

Particularly when a breathing apparatus 100 is used for industrial applications, for example, as an escape apparatus in a petrochemical plant, such a use can be expedient. For such an escape application, the pressurized gas cylinder 1 would be smaller in design than in the basic illustration of FIG. 1.

Each of the male coupling pieces 11*a*. 12*a* has a flow check valve 13, 14, so that the breathing gas line 3, 6 to the regulator 4 is closed off when no breathing gas source 1 is connected. In the illustrated embodiment, the flow check valves 13, 14 are located on the side that has the regulator 4. In alternative embodiments, they can also be located on the side that has the lines 3, 6. This means that the male coupling pieces 11*a*, 12*a* and female coupling pieces 11*b*, 12*b* can be arranged as desired, in principle.

Figure 3:
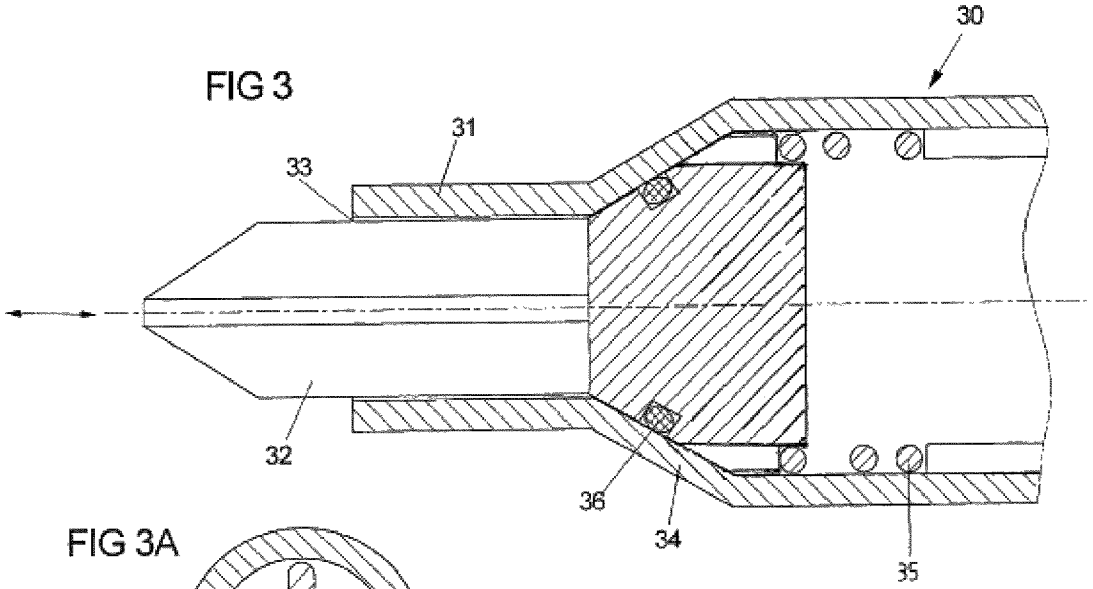
FIG. 3 illustrates a sectional view along a coupling piece of an embodiment of a connecting piece in the closed position.

In one embodiment, the couplers 11, 12 have an added function which makes attaching a new breathing gas source 1 safer. In this function, two contact stages are implemented for connection of the male coupling pieces 11*a*. 12*a*. In a first contact stage, the flow check valve 13, 14 is opened slightly, allowing a small amount of breathing gas to flow through, thereby removing any harmful gases (e.g., hydrogen sulfide, cyanide, etc.) that may be present in the surrounding air under certain circumstances from the area around the couplers 11, 12, before, in a second contact stage, a connection is produced between breathing gas source 1 and regulator 4, which allows breathing gas to be supplied. Small amounts of harmful gas that have collected in the area around the couplers 11, 12 are thereby prevented from being conducted to the regulator 4 once the new breathing gas source 1 has been connected. One embodiment of a male coupling piece 11*a*, 12*a* with a flow check valve 13, 14 is shown in FIG. 3.

In principle, different variants for flushing the coupling area by means of the described two contact stages are conceivable. For instance, in a first contact stage, the breathing gas from a first breathing gas source 1 (e.g., a nearly empty pressurized gas cylinder) can be used for flushing. It is also possible to use the gas from the new second breathing gas source in the first contact stage. A combination of these two options is also conceivable, in which the flushing gas would come from both breathing gas sources.

Figure 2:
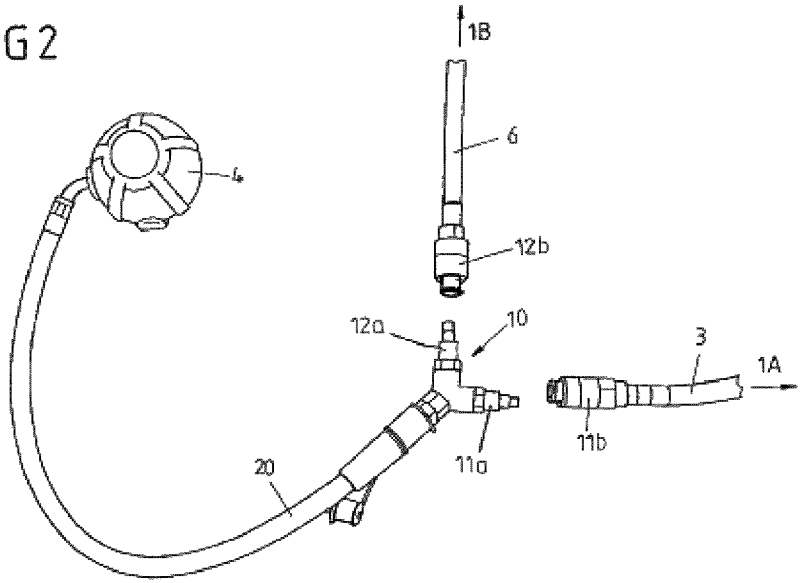
FIG. 2 illustrates an enlarged illustration of another embodiment of the coupling device.

FIG. 2 shows the integration of a connecting piece 10 with the regulator 4, in an enlarged illustration of the configuration of FIG. 1. The connecting device 10 is inseparably connected to the regulator hose 20. In this case, the connecting device 10 is embodied as Y-shaped. In alternative embodiments, it can also be embodied as T-shaped. Also possible are variants in which the connecting device 10 has freely configurable couplers, particularly more than two, in a forked or comb-shaped arrangement. The attachments can also be interchangeable. In all embodiments, two lines 3, 6 can be coupled to the respective male coupling pieces 11*a*, 12*a* of the connecting device 10. In this embodiment, the two female coupling pieces 11*b*, 12*b* can be connected to male coupling pieces 11*a*, 12*a*, each having a flow check valve 13, 14, via the connecting device 10.

In one embodiment, the male coupling pieces 11*a*, 12*a* are part of the connecting device 10 while the female coupling pieces 11*b*, 12*b* are securely coupled to the intermediate pressure lines; more particularly, the first coupler 11 is connected to the intermediate pressure line 3 and the second coupler 12 is connected to an auxiliary line 6. The intermediate pressure line 3 leads to a first breathing gas source 1A, not shown here, and the auxiliary line leads to a second breathing gas source 1B, not shown here.

Figure 2A:
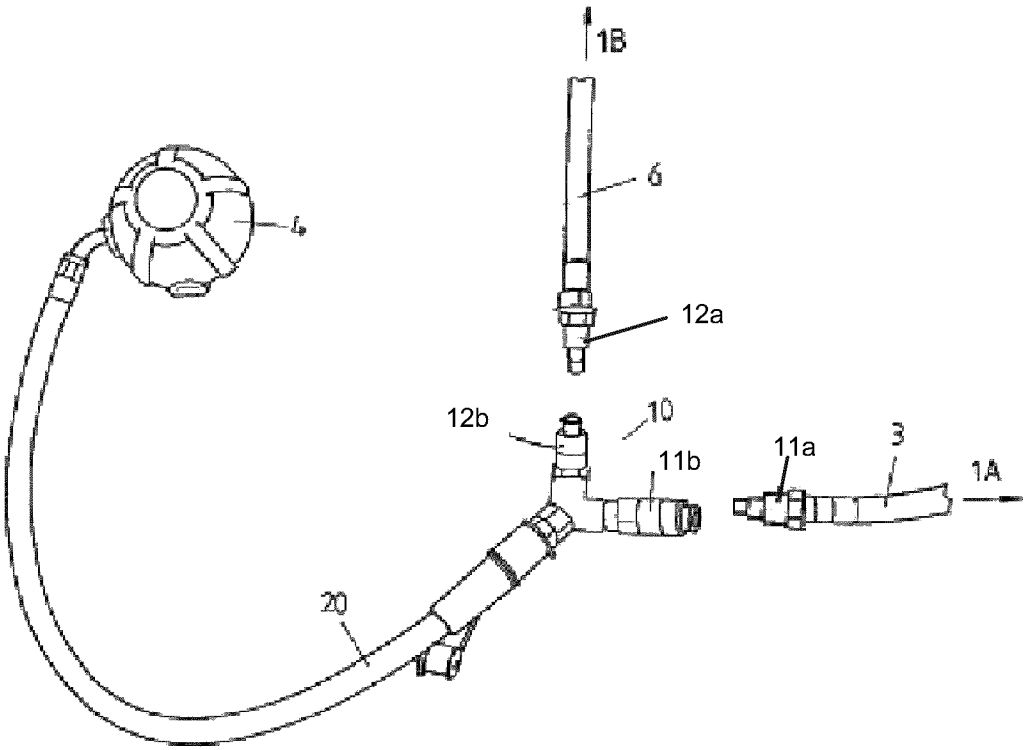
FIG. 2A illustrates an enlarged illustration of another embodiment of the coupling device.

In principle, it is also possible for the female coupling pieces 11*b*, 12*b* to be located on the connecting device 10 and the corresponding male coupling pieces 11*a*, 12*a* on the lines 3, 6, as illustrated in FIG. 2A.

FIG. 3 shows a sectional view of the embodiment of FIG. 2A wherein a male coupling piece 11*a*, which is connected to a line 3 for conducting breathing gas has a flow check valve 13. The secure and fixed connection of the male coupling piece 11*a* to the line 3 is produced by a housing 30. The housing 30 transitions toward the line end into a tubular section 31, in which a lifter 32 is arranged as part of the flow check valve 13. The lifter 32 is encompassed by the tubular section 31 and is arranged axially movable therein (see the double arrow in FIG. 3).

The lifter 32 projects out of an opening 33 at the end of the housing 30. At the end of the lifter 32 which is opposite the opening 33, a conical section 34 of the lifter 32 is pressed by a spring 35 against an also conical section of the housing 30. An annular seal 36 arranged in the conical section 34 of the lifter 32 keeps pressurized breathing gas that is in the line 3 in the line 3 when the lifter 32 is in the position shown; the line 3 is sealed over the conical sealing surface by the flow check valve 13. The flow check valve 13 therefore comprises the lifter 32, the conical section 34 of the housing 30 surrounding it, and the spring 35.

Figure 3A:
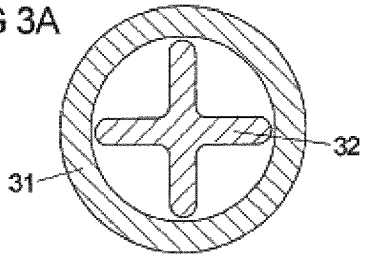
FIG. 3A illustrates a front view of a coupling piece according to FIG. 3.

In the section that projects out of the opening, the lifter 32 has a cruciform cross-section, as is clear from FIG. 3A, which shows a front view of the coupling piece 11*a*. The ribs of the lifter 32, which point radially toward the wall of the housing 30, support said lifter against the housing 30, so that the lifter 32 is movable and guided axially securely in the housing 30. This type of guidance of the lifter 32 permits low-friction movement, even when the lifter 32 has been soiled, for example, with sand. In alternative embodiments, the cross-section of the lifter 32 is embodied as polygonal, particularly triangular or star-shaped.

In principle, the seal 36 can also be different in certain embodiments. For instance, a purely axial seal 36 is also possible, in which an annular seal 36 is arranged on a surface that is oriented perpendicular to the longitudinal axis of the lifter 32, and rests on a sealing surface which is also oriented perpendicular to the longitudinal axis of the lifter 32.

Figure 4:
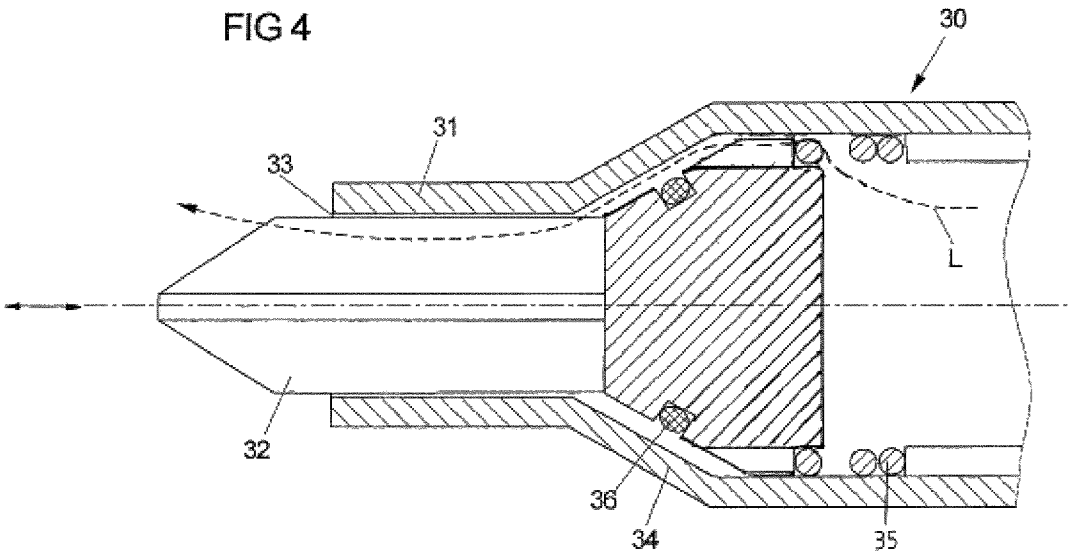
FIG. 4 illustrates a sectional view of a coupling piece according to FIG. 3 in a flow through position.

FIG. 4 shows the embodiment of the male coupling piece 11*a* of FIG. 3 in a position in which breathing gas can flow out of the line 3 (flow through position). For this purpose, the lifter 32 is pressed in the direction of the housing 30, so that in the region of the conical section 34 of the housing 30, a gap is formed, through which air L can escape from the line 3 in the direction of the opening 33. The cruciform embodiment of the front part of the lifter 32 allows the breathing gas to escape with low resistance. The lifter 32 is moved to this position when the female coupling piece 11*b* is first being coupled to the coupling piece 11*a* of the connecting device 10. This position forms the first contact stage wherein the breathing gas removes any harmful gasses from the female coupling piece 11*b*. As the coupling pieces 11*a* and 11*b* are pushed further into full mating contact, the second contact stage is reached, such as shown in FIG. 1.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A breathing system, comprising:

a connecting device connected to a regulator hose via an outlet;

the connecting device having at least two inlet coupler portions, each of the at least two inlet coupler portions configured to receive gas from a corresponding breathing gas source;

each of the at least two inlet coupler portions configured for reversible connection to a corresponding outlet coupler portion of at least one flexible breathing hose;

a mask having a regulator;

the regulator of the mask being connected to the connecting device by the regulator hose; and the at least one flexible breathing hose configured to connect at one end to the connecting device via one of the at least two inlet coupler portions of the connecting device;

the at least one flexible breathing hose configured to connect at another end to the breathing gas source;

the regulator hose being irreversibly connected to the connecting device;

the at least one flexible breathing hose being configured for reversibly connecting to the connecting device;

wherein each of the at least two inlet coupler portions cooperate with a check valve disposed within the corresponding outlet coupler portion of the at least one flexible breathing hose, each check valve comprising:

a housing having a first tubular section connected to a second tubular section by a conical section, with the first tubular section having a smaller inner diameter than the second tubular section, and a lifter having a first end displaceable within the first tubular section of the housing and a second conical end configured for sealing against the conical section of the housing, the first end of the lifter having ribs supported against the first tubular section during movement of the lifter within the first tubular section;

wherein each check valve is configured to provide two contact stages during an initial connection of the corresponding outlet coupler portion of the at least one flexible breathing hose to one of the at least two inlet coupler portions of the connecting device;

wherein a first of the two contact stages allows a flushing amount of breathing gas to flow through each check valve in a direction from the at least one flexible breathing hose toward the regulator hose and prior to supplying breathing gas to the regulator hose; and wherein a second of the two contact stages allows breathing gas to flow freely through the connecting device from the at least one flexible breathing hose to the regulator hose.

2. The breathing system according to claim 1, wherein the one end of the at least one flexible breathing hose has the corresponding outlet coupler portion for connection with one of the at least two inlet coupler portions.

3. The breathing system according to claim 1, wherein the first end of the lifter has a cruciform, a polygonal, a triangular or a star-shaped cross-section.

4. The breathing system according to claim 3, wherein:

the corresponding outlet coupler portion of the at least one flexible breathing hose further comprises a spring;

the second end of the lifter being spring loaded against the conical section of the housing; and the lifter displacing towards and compressing the spring when connected to one of the at least two inlet coupler portions of the connecting device.

5. The breathing system of claim 4, wherein:

the lifter further comprises a seal on the second conical end;

the lifter compressing the spring and lifting the seal off of a housing surface of the conical section of the housing to permit airflow through the corresponding outlet coupler portion.

* * * * *